US009945368B2

(12) United States Patent
Watanabe et al.

(10) Patent No.: US 9,945,368 B2
(45) Date of Patent: Apr. 17, 2018

(54) NON-EVAPORABLE GETTER AND NON-EVAPORABLE GETTER PUMP

(71) Applicant: Vaclab Inc., Tsukuba (JP)

(72) Inventors: Fumio Watanabe, Tsukuba (JP); Reiki Watanabe, Tsukuba (JP)

(73) Assignee: Vaclab Inc., Ibaraki (JP)

( * ) Notice: Subject to any disclaimer, the term of this patent is extended or adjusted under 35 U.S.C. 154(b) by 253 days.

(21) Appl. No.: 14/819,093

(22) Filed: Aug. 5, 2015

(65) Prior Publication Data

US 2016/0069338 A1 Mar. 10, 2016

(30) Foreign Application Priority Data

Aug. 8, 2014 (JP) ..... 2014-162078

(51) Int. Cl.
*F04B 37/02* (2006.01)
*H01J 7/18* (2006.01)
*F04B 37/08* (2006.01)

(52) U.S. Cl.
CPC ..... *F04B 37/02* (2013.01); *F04B 37/08* (2013.01); *H01J 7/18* (2013.01); *H01J 7/186* (2013.01)

(58) Field of Classification Search
CPC ... F04B 37/02; F04B 37/08; H01J 7/18; H01J 7/186
USPC ..... 417/48–51
See application file for complete search history.

(56) References Cited

U.S. PATENT DOCUMENTS 2,640,949 A * 6/1953 Cook ..... H01J 1/28 313/337
3,609,062 A * 9/1971 Zucchinelli ..... H01J 7/18 313/558
3,609,064 A * 9/1971 Giorgi ..... H01J 7/18 417/51
3,662,522 A * 5/1972 Della Porta ..... H01J 7/18 417/51
3,737,709 A * 6/1973 Hornman ..... H01J 7/186 313/561
3,780,501 A * 12/1973 Porta ..... H01J 7/18 252/181.5
3,961,897 A * 6/1976 Giorgi ..... F04B 37/02 417/49
4,515,528 A * 5/1985 Young ..... H01J 29/84 313/547
5,320,496 A * 6/1994 Manini ..... F04B 37/02 417/51

(Continued)

FOREIGN PATENT DOCUMENTS

JP 40-2962 2/1965
JP 2004-202309 7/2004

(Continued)

OTHER PUBLICATIONS

S. Fujimoto et al., Report of Ehime Institute of Industrial Technology, No. 48, 2010 "Development of a new production technique of hydrogen-storing alloy (part 1) . . . ."

*Primary Examiner* — Peter J Bertheaud
(74) *Attorney, Agent, or Firm* — Muramatsu & Associates

(57) ABSTRACT

A non-evaporable getter 1 includes a mesh 3, a frame 2 which is attached to the mesh 3 and suppresses deformation of the mesh 3, and a powder-state getter material 4 which is surrounded by the mesh 3 and the frame 2, and whose particle size is larger than a mesh opening of the mesh 3.

5 Claims, 15 Drawing Sheets

(56) References Cited

U.S. PATENT DOCUMENTS

| | | | | |
|---|---|---|---|---|
| 5,328,336 | A * | 7/1994 | Nowobilski | F04B 37/04 417/48 |
| 5,772,404 | A * | 6/1998 | Carella | F04B 37/02 417/313 |
| 5,911,560 | A * | 6/1999 | Krueger | C23C 14/54 417/48 |
| 2008/0028931 | A1 | 2/2008 | Coda et al. | |
| 2009/0148635 | A1 | 6/2009 | Coda et al. | |

FOREIGN PATENT DOCUMENTS

| | | |
|---|---|---|
| JP | 2008-520831 | 6/2008 |
| JP | 2009-541586 | 11/2009 |
| JP | 2014-118940 | 6/2014 |

* cited by examiner

NON-EVAPORABLE GETTER AND NON-EVAPORABLE GETTER PUMP

CROSS-REFERENCE TO RELATED APPLICATION

This application is based on and priority of Japanese Patent Application No. 2014-162078 filed on Aug. 8, 2014, the entire contents of which are incorporated herein by reference.

FIELD

The present invention relates to a non-evaporable getter and a non-evaporable getter pump having the non-evaporable getter.

BACKGROUND

There are various types of vacuum pump for realizing a vacuum state by being attached to a vacuum chamber and performing pumping. One of the pumps is a getter pump which removes gas residual in a vacuum chamber by using a getter having sorbing characteristic to various gas molecules. There are an evaporable getter which is used by evaporating (sublimating) a metal getter material and a non-evaporable getter which does not require evaporation.

The non-evaporable getter has a type which is used by pulverizing alloy that sorbs gas molecules into a powder-state or a type which is used by compressing the powder-state getter material and molding it into a pill-state (tablet state), for example. Of the types, the latter one is mostly used.

As prior art documents related to the non-evaporable getter and the non-evaporable getter pump having the getter, there are Published Japanese Translation of PCT Application No. 2009-541586 (Patent Document 1) and Japanese Patent Laid-open No. 2004-202309 (Patent Document 2) as patent documents. Further, there is Bulletin of Institute of Industrial Technology of Ehime Prefecture No. 48, p 18-20 2010 as a non-patent document.

SUMMARY

It is an object of the present invention to provide a non-evaporable getter capable of preventing a powder-state getter material from being dispersed and a non-evaporable getter pump having the getter.

According to one aspect of the disclosed technology, there are provided a non-evaporable getter having a mesh, a frame which is attached to the mesh and suppresses deformation of the mesh, and a powder-state getter material which is surrounded by the mesh and the frame, and whose particle size is larger than a mesh opening of the mesh, and a non-evaporable getter pump having the getter.

The object and advantages of the invention will be realized and attained by means of the elements and combinations particularly pointed out in the claims.

It is to be understood that both the foregoing general description and the following detailed description are exemplary and explanatory and are not respective of the invention, as claimed.

BRIEF DESCRIPTION OF THE DRAWINGS

FIG. 2A, 2B are views illustrating an example of a method of attaching a mesh to a frame of the non-evaporable getter of the first embodiment, in which FIG. 2A is a cross-sectional view illustrating a state before attaching, and FIG. 2B is a cross-sectional view illustrating a state after attaching.

FIG. 14A is a perspective view, FIG. 14B is a cross-sectional view along a plane II of FIG. 14A, and FIG. 14C is a perspective view of a C-cut tapered screw being a holding member of the non-evaporable getter.

DESCRIPTION OF THE PREFERRED EMBODIMENTS

First, before explaining embodiments, preliminary items for facilitating understanding of embodiments will be explained.

In a non-evaporable getter, the larger a specific surface area (surface area per unit mass) of a getter material becomes, the more the getter material can sorb gas molecules. Therefore, it is desirable to process the getter material into a powder state or to process the material into a pill state by compressing after processing the material into a powder state once.

However, a powder-state getter material is easily dispersed. Or even if the materials are formed into a pill state, powder falls out of the pill-state getter material to disperse when it receives vibration or abrasion during conveyance or during use. This could cause an adverse effect to a vacuum device using the non-evaporable getter pump.

Patent Document 2 discloses a non-evaporable getter in which a powder-state getter material is surrounded by a mesh having a smaller mesh opening than a particle size of the powder-state getter material.

However, because such a mesh of the non-evaporable getter has an extremely fine mesh opening and an extremely small wire diameter, it is difficult to maintain a shape of the mesh. For this reason, there is a problem that the mesh is easily deformed due to external pressure added during conveyance or own weight of the non-evaporable getter.

When the mesh is deformed, the mesh and powder-state getter materials in the mesh are rubbed against each other or the getter materials are rubbed against each other, by which fine powder having a smaller particle size could be generated.

This could make the fine powder to leak outside the mesh and disperse, and could also cause an adverse effect to the vacuum device.

Further, in the case where the mesh opening of the mesh is made even smaller to prevent the fine powder from being leaked, there is a problem that inflow of gas molecules is disturbed, and the pumping speed of the non-evaporable getter pump is reduced.

Embodiments described below solve such problems.

First Embodiment

A non-evaporable getter of the first embodiment will be explained. Hereinafter, a non-evaporable getter will be expressed as an NEG, and a non-evaporable getter pump will be expressed as an NEG pump.

Figure 1A:
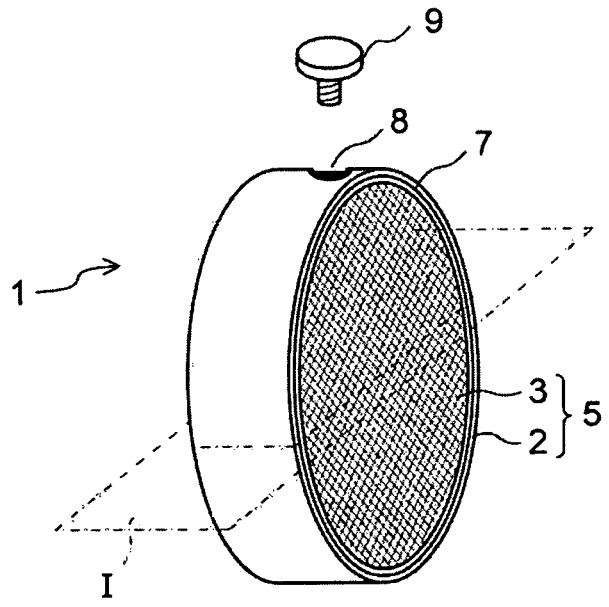
FIG. 1A is a perspective view illustrating a non-evaporable getter of a first embodiment.
Figure 1B:
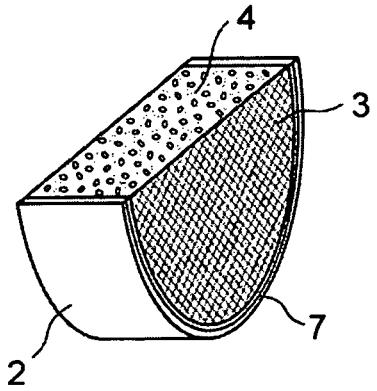
FIG. 1B is a perspective view illustrating a cross section along a plane I of FIG. 1A.

FIG. 1A is a perspective view illustrating the NEG of the first embodiment, and FIG. 1B is a perspective view illustrating a cross section along a plane I of FIG. 1A.

In the first embodiment, as illustrated in FIG. 1, a container 5 is fabricated by stretching stainless-steel mesh 3 to a short cylindrical stainless-steel frame 2 from both sides of the frame 2 so as to cover an opening of the frame 2. A type such as a plain-woven type, an etching type, a punching metal type or the like can be used for the mesh 3. A powder-state getter material 4 is input into the container 5 to form an NEG 1.

As a method of attaching the mesh 3 to the frame 2, any method may be applied as long as the powder-state getter material 4 can be prevented from being leaked from the container 5. As such method, there is a method of attaching the mesh by spot welding or the method illustrated in FIG. 2, for example.

Hereinafter, the method illustrated in FIG. 2 will be explained.

Figure 2A:
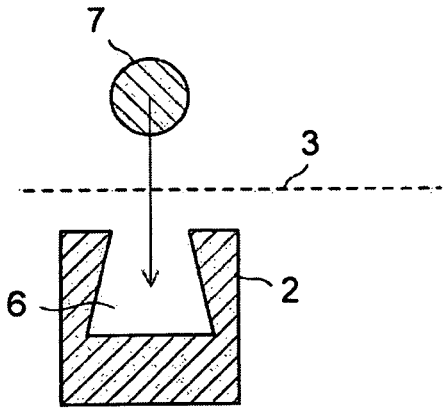
Figure 2B:
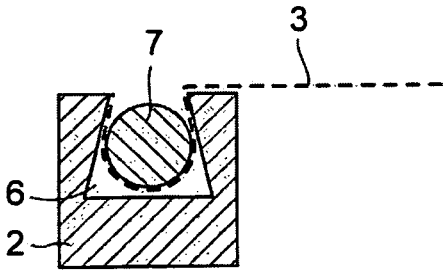

FIGS. 2A, 2B illustrate an example of a method of attaching a mesh to a frame of the NEG of the first embodiment. FIG. 2A is a cross-sectional view illustrating a state before attaching, and FIG. 2B is a cross-sectional view illustrating a state after attaching.

As illustrated in FIGS. 2A, 2B, there is a method in which a groove 6 having a trapezoidal cross section is formed on a side surface of the frame 2, the mesh 3 is placed onto the groove 6, the mesh 3 is pushed into the groove 6 by a ring-shaped metal wire 7, and a needless portion of the mesh 3 is cut off, by which the mesh 3 is attached to the frame 2. When a diameter of the wire 7 is made slightly larger than a width of an opening of the groove 6 (upper side of trapezoid), the mesh 3 can be fixed to the frame 2.

A female screw 8 penetrating the frame 2 is formed on the frame 2. After inputting the powder-state getter material 4 into the container 5 from the female screw 8, a stainless-steel male screw (plug) 9 is plugged into the female screw to prevent the getter material 4 from being leaked.

The powder-state getter material 4 surrounded by the mesh 3 and the frame 2 is sorted by a sieve to limit a particle size to one larger than the mesh opening of the mesh 3 in order to prevent leakage from the container 5. Specifically, it is preferable to set an opening dimension of the mesh 3 to 30 μm or more in order not to block inflow of gas molecules. Further, it is preferable to set a particle size of the getter material 4 to be larger than the opening dimension of the mesh 3 by around 10 μm or more.

At the same time, in order to increase a specific surface area of the getter material 4, it is preferable to set an upper limit of the particle size of the getter material 4 to be small within a range where there is no chance of leaking the getter material 4. Specifically, it is preferable to set the upper limit of the particle size of the getter material 4 to about 200 μm. The upper limit is set to this level because of the reason below. Specifically, when alloy of the getter material 4 is pulverized, powder in which particle sizes are dispersed from several μm to 300 μm is obtained. Accordingly, the powder can be used with as little waste as possible. Alternatively, the upper limit of the particle size of the getter material 4 may be formed even smaller in the case of emphasizing an increase of the specific surface area.

For example, when the opening dimension is 41 μm, the particle size of the getter material 4 may be set to 50 μm or more and 180 μm or less. In order to sort the getter material 4 in this way, a double sieve having an opening dimension of an upper mesh opening at 180 μm and an opening dimension of a lower mesh opening at 49 μm, for example, may be used. Now, it is also possible to set the upper limit of 180 μm to a smaller size as described above.

Furthermore, it is preferable to perform blast treatment or the like to form each particle as round as possible to make it difficult to generate a fragment or the like by abrasion. Consequently, fragment or fine powder can be prevented from being leaked outside the mesh 3.

The powder-state getter material 4 may be various types of alloy or pure metal. For example, alloy of zirconium, vanadium and iron can be used. The alloy contains zirconium at 70%, vanadium at 24.5% and iron at 5.4%, for example. Additionally, alloy containing zirconium (84%) and aluminum (16%), alloy containing zirconium (76.5%) and iron (23.5%), alloy containing zirconium (50%), vanadium (25%), titanium (15%) and iron (10%), alloy containing titanium (70%) and vanadium (30%), or alloy containing titanium and zirconium, or the like can be used.

Further, it is preferable that a material of the frame 2, the mesh 3 and the male screw 9 be a material that is not deteriorated when it contacts the getter material 4 at high temperature, which is stainless steel, for example. Alternatively, the material, other than stainless steel, also may be a refractory metal such as molybdenum and tungsten, or ceramics.

According to the NEG 1 of the first embodiment above, the frame 2 suppresses deformation of the mesh 3. With this, generation of fine powder of the getter material 4 can be suppressed and fine powder can be prevented from being leaked and dispersed.

Further, since the mesh 3 is not deformed when moved while clamping the frame 2, there is also an advantage that the mesh 3 is easily handled.

Further, a shaft of the male screw 9 may be made longer than the thickness of the frame 2. Thereby, gap among the getter materials 4 can be narrowed to thus prevent the getter materials 4 from moving smoothly in the container 5. Accordingly, an effect of suppressing generation of fine powder can be increased as well.

Further, since a high-cost process of compressing the powder to mold into a pill state is unnecessary, cost can be also suppressed significantly.

Next, an example of an NEG pump equipped with the NEG 1 of the first embodiment will be explained.

Figure 3:
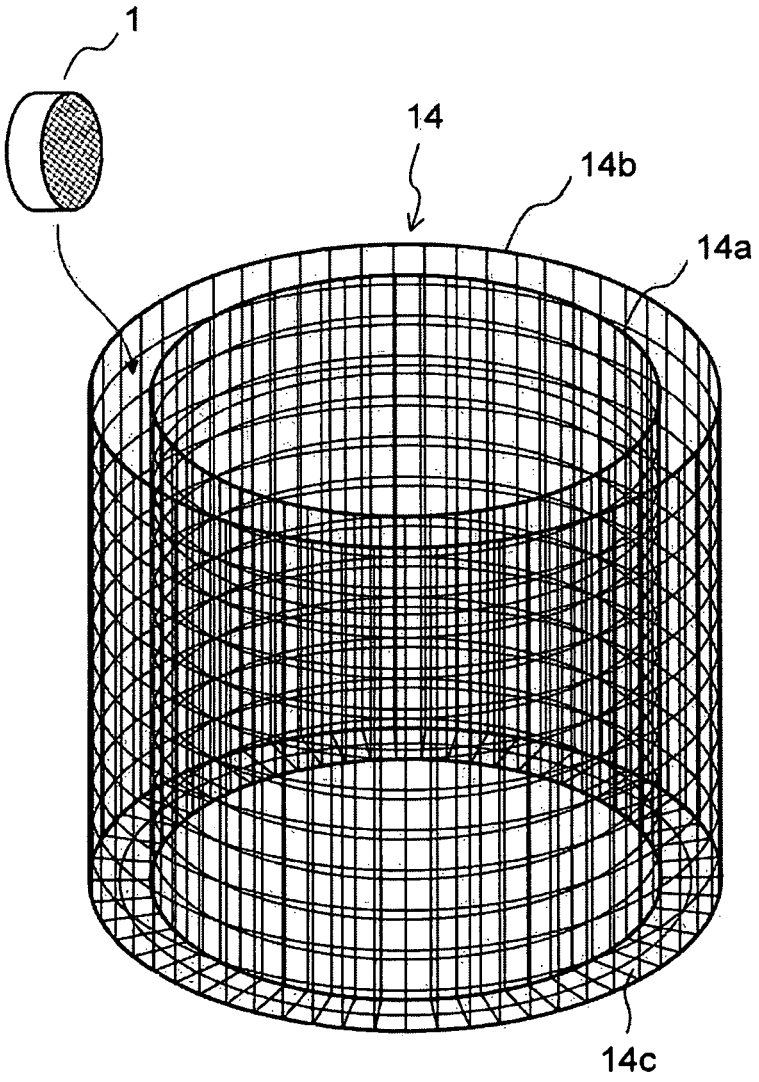
FIG. 3 is a perspective view illustrating a basket into which a plurality of non-evaporable getters of the first embodiment are input.

FIG. 3 is a perspective view illustrating a basket into which a plurality of NEGs of the first embodiment are input.

Figure 4:
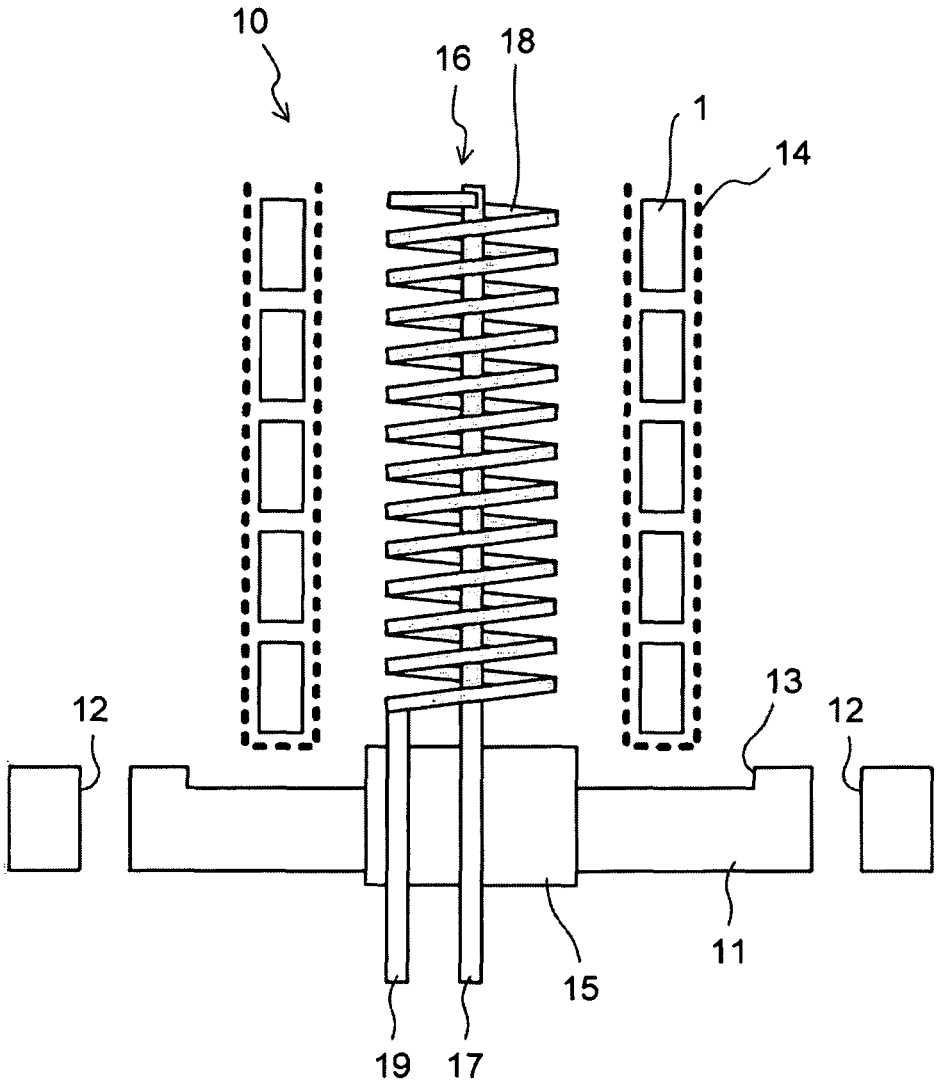
FIG. 4 is a cross-sectional view illustrating a non-evaporable getter pump equipped with the plurality of non-evaporable getters of the first embodiment.

FIG. 4 is a cross-sectional view illustrating the NEG pump equipped with the plurality of NEGs of the first embodiment.

As illustrated in FIG. 4, the NEG pump 10 equipped with the NEG 1 of the first embodiment is connected to a vacuum chamber (not illustrated) via a disc-shaped vacuum flange 11. Holes 12 through which fixing bolts (not illustrated) are inserted are formed, and an edge 13 for sandwiching a gasket (not illustrated) is formed on the vacuum flange 11.

As illustrated in FIG. 3 and FIG. 4, a basket 14 is fabricated as followed. That is, two cylindrical stainless-steel wire meshes 14*a*, 14*b* having different diameters are overlaid, and a bottom side between the inner wire mesh 14*a* and the outer wire mesh 14*b* is covered by a wire mesh 14*c* while a top side is left open. A large number of the NEGs 1 are vertically input into the basket 14. A gap between the inner wire mesh 14*a* and the outer wire mesh 14*b* is approximately the same as the thickness of the NEG 1, and the NEGs are fully input into the basket 14 such that the NEGs 1 become a closest packing structure when the basket 14 is seen laterally.

The basket 14 filled with the NEGs 1 is installed on the vacuum flange 11. A radiation-type heater 16 is fixed at a columnar central part 15 of the vacuum flange 11. The heater 16 has two rod-shaped terminals 17, 19 penetrating the central part 15 and being connected to a power source and a helical heat generating section 18 joined between the two rod-shaped terminals 17, 19.

At a first time and when sorption power of the NEGs 1 drops after that, treatment called activation is performed. The treatment called activation includes heating the NEGs 1 by the heater 16 from the inside of the basket 14 and thus absorbing gas molecules sorbed on the surface of the getter material 4 inside the material. This makes it possible to use the NEGs 1 repeatedly. The central axis of the heat generating section 18 of the heater 16 matches the central axis of the basket 14, and the meshes 3 of the NEGs 1 filled in the basket 14 face the heater 16. For this reason, it is possible to efficiently transmit heat from the heater 16 evenly to the getter material 4 of each NEG 1.

A diameter and a height of the basket 14 can be freely designed. It is possible to increase the number of the NEGs 1 to be input into the basket 14 by design, and thus an NEG pump of a high pumping speed can be provided.

The NEG 1 of the first embodiment and the NEG pump 10 equipped with the NEG can be used for an electron source section of an accelerator, an electron microscope or the like. Extremely high voltage is applied to an electrode in application to such apparatus. In the case, powder is electrified if the powder-state getter material 4 is located near the electrode. Then, the material could fly to collide the electrode and damage the electrode. According to the NEG 1 of the first embodiment, the mesh 3 serves as an electrostatic shield, and can prevent electrification of the powder-state getter material 4. An effect of the electrostatic shield can be enhanced even more when mesh openings of the mesh 3 are made finer, and the mesh 3 is grounded.

Performance Investigation of NEG Pump of First Embodiment

The NEG 1 of the first embodiment and the NEG pump 10 equipped with the NEG were fabricated under a conditions below, and performance was investigated.

The cylindrical stainless-steel frame 2 had an outer diameter at 10 mm, an inner diameter at 9 mm, and a length in an axis direction at 3 mm. The stainless steel mesh 3 is plain-woven, and has an opening dimension at 41 μm. The powder-state getter material 4 is alloy containing zirconium 70%, vanadium 24.6% and iron 5.4%, and has a particle size at 50 μm or more and 180 μm or less.

To increase the pumping speed of the NEG pump 10, it is preferable to encapsulate as much powder-state getter material 4 as possible into the container 5 of the NEG 1. It was possible to input approximately 0.93 g of the powder-state getter material 4 into the container 5 of the NEG 1 fabricated for the investigation. For comparison, an NEG was fabricated by mixing entire powder formed of particles whose particle size distributes from several μm to 300 μm and then compressing them into a pill state with a diameter at 10 mm and a thickness at 3 mm each being the same size as the above-described NEG 1. The weight of the NEG is 1.0 g in a loosely compressed case, and 1.2 g in a strongly compressed case. Therefore, although slightly small comparing to the pill-state NEG, the getter material 4 of an amount not so different can be input into the container 5.

Further, it was confirmed that the powder-state getter material 4 whose particle size was set to 50 μm or more and 180 μm or less was smooth like sand in a sand timer and less likely to cause a lump, and also could be input easily into the container 5 from the small female screw 8 comparing to the powder-state getter material having the particle size from several μm to 300 μm.

Figure 5:
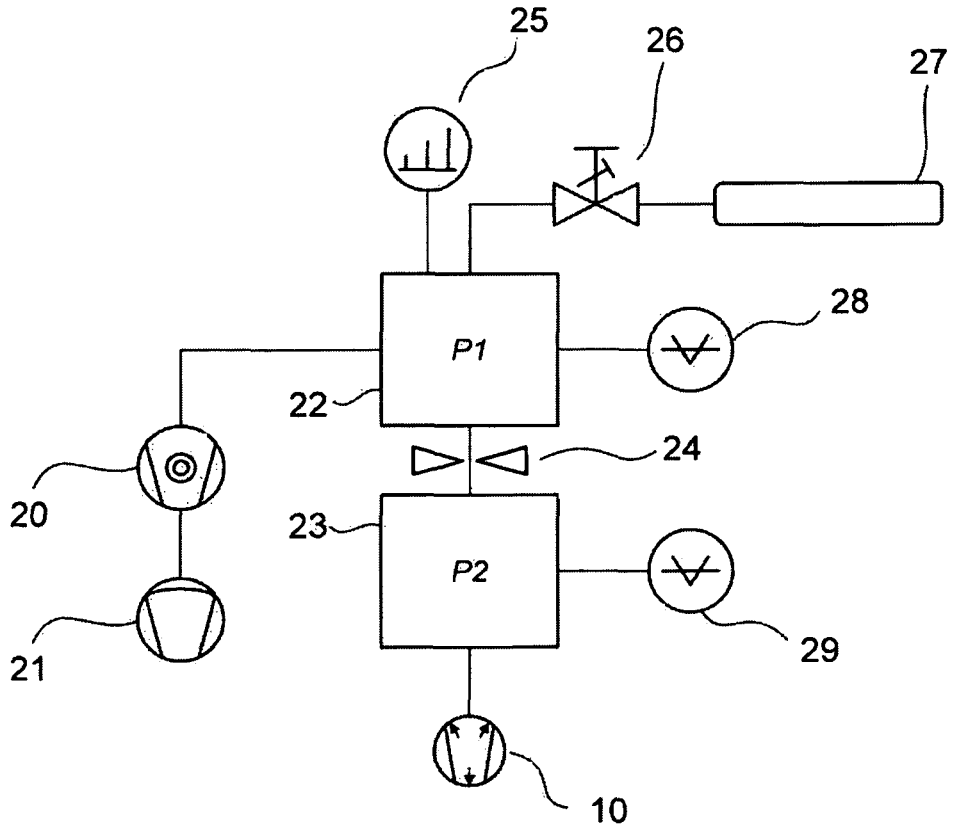
FIG. 5 is a view illustrating a constitution of a vacuum apparatus for investigating the performance of the non-evaporable getter pump equipped with the non-evaporable getter of the first and third embodiments.

The basket 14 of the NEG pump 10 had a 10 Mesh (indication based on Japan Industrial Standard) and an opening dimension at 2.5 mm. In the basket 14, 8 pieces were arrayed along a circumference of the basket 14 and set in 5 layers, then 40 pieces of the NEGs 1 were arranged in total. As the vacuum flange 11, a standard product CF70 of a ConFlat flange having an outer diameter at 70 mm was used. FIG. 5 is a view illustrating a constitution of a vacuum apparatus for investigating the performance of an NEG pump equipped with the NEG of the first embodiments.

The vacuum apparatus include a first chamber 22 to which a turbo-molecular pump 20 and a diaphragm pump 21 are connected and a second chamber 23 to which the NEG pump 10 for investigating performance is connected. The first chamber 22 and the second chamber 23 are connected to each other via an orifice plate 24. A quadrupole mass spectrometer 25 is also connected to the first chamber 22.

The turbo-molecular pump 20 and the diaphragm pump 21 were brought into operation to start pumping, and then activation of the NEGs 1 was performed at 450° C. for 30 minutes immediately after baking for outgassing of the vacuum devices. After that, the NEGs were left to stand in an environment of room temperature, then vacuum inside each of the chambers reached approximately $10^{-9}$ Pa.

From this state, a leak valve 26 connected to the first chamber 22 was loosened to introduce hydrogen gas as a sample from a gas cylinder 27.

Pressure P1 in the first chamber 22 was measured by a first vacuum gauge 28 connected to the first chamber 22, pressure P2 in the second chamber 23 was measured by a second vacuum gauge 29 connected to the second chamber 23.

Then, the pumping speed S ($H_2$) of the NEG pump 10 to P2 was obtained from a calculation formula $S(H_2)=C[(P1-P1b)/(P2-P2b)-1]$ and the relation between them was given into a graph. At this point, C denotes conductance of a conduit, and P1*b* and P2*b* respectively denote pressure in the first chamber 22 and the second chamber 23 immediately before introducing hydrogen gas as the sample.

Further, each of the pressure P1 and P2 has Pa (Pascal) as a unit, the conductance C is a factor representing easiness of allowing gas to pass through, the conductance C at room temperature which is used in this test is 3.74 (L/s) for hydrogen and 1.00 (L/s) for carbon monoxide.

Afterwards, the first chamber 22 and the second chamber 23 were opened to introduce dry air into the chambers and the NEGs 1 to have undergone activation once was exposed to the air. From the state, further pumping and activation were performed in the same manner as the first time. Then, the pumping speed S ($H_2$) of the NEG pump 10 was checked and given into a graph. Results were illustrated by Δ marks and ▲ marks in FIG. 6.

Figure 6:
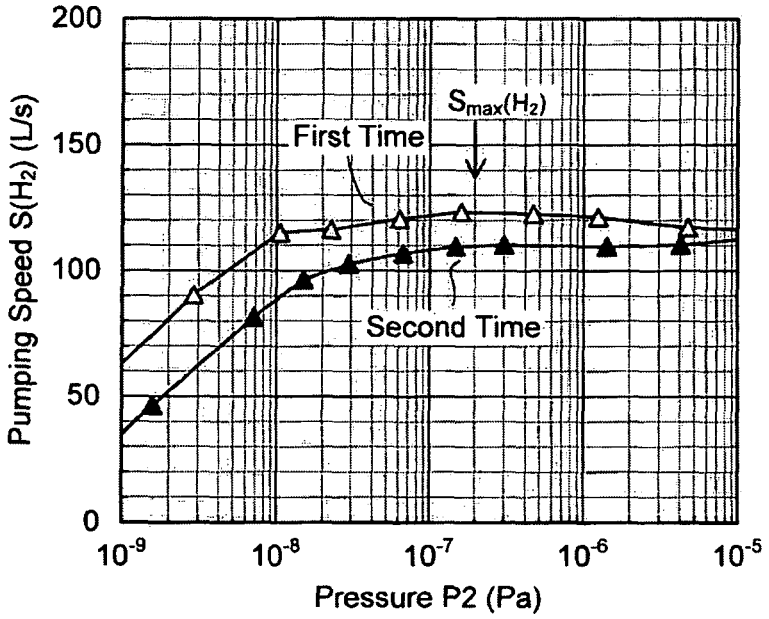
FIG. 6 is a graph illustrating investigation results of the performance of the non-evaporable getter pump equipped with the non-evaporable getters of the first embodiment by using the vacuum apparatus of FIG. 5.

FIG. 6 is a graph illustrating investigation results of the performance of the NEG pump equipped with the NEG of the first embodiment by using the vacuum apparatus of FIG. 5.

In FIG. 6, Δ marks denote pumping speed S ($H_2$) for hydrogen in the first investigation, and ▲ marks denote the pumping speed S ($H_2$) for hydrogen in the second investigation. Forty pieces of the NEGs 1 were used as the getter material 4, which was approximately 37.2 g.

The most important item in evaluating the performance of the NEG pump is the maximum pumping speed $S_{max}$ ($H_2$), and its value in the first time was approximately 120 L/S.

The second important item is a degree of deterioration of NEG when the NEG pump is used to repeat the above-described exposure to the atmosphere and the activation of NEG. The degree of deterioration represents how high the maximum pumping speed $S_{max}$ ($H_2$) in the first time is maintained after the first time. This is a lifetime index of NEG. The maximum pumping speed $S_{max}$ ($H_2$) in the second investigation was approximately 110 L/S, and thus a degree of deterioration from the first time was approximately 8.3%.

For comparison, an NEG pump was fabricated using 40 pieces (48 g) of pill-state NEGs in the same manner as the embodiment, and pumping speed was investigated in a similar method to the embodiment. The pill-state NEGs were prepared by mixing entire powder formed of particles which were made of the same alloy as that of the embodiment and whose particle sizes distributed from several μm to 300 μm, and then compressing it to mold a pill state of a diameter at 10 mm, a thickness at 3 mm and a weight at 1.2 g.

It resulted in approximately 170 L/S of the first time $S_{max}$ ($H_2$) and approximately 123 L/S of the second time $S_{max}$ ($H_2$). When the results are converted to the pumping speed per 37.2 g which is the same as the first embodiment, $S_{max}$ ($H_2$) in the first time was approximately 132 L/S and $S_{max}$ ($H_2$) in the second time was approximately 95 L/S. A degree of deterioration from the first time was approximately 27.6%.

Although the maximum pumping speed of the NEG 1 of the first embodiment is slightly smaller than that of the pill-state NEG in the first use of those NEGs, it already exceeded that of the pill-state NEG in the second use. Assuming that the NEG 1 of the first embodiment and the pill-state NEG are continuously deteriorated by 8.3% and 27.6% respectively on and after the second use of those NEGs as well, the maximum pumping speed of the NEG 1 of the first embodiment becomes larger than that of the pill-state NEG on and after the second use. The NEG 1 of the first embodiment can be used for 9 times counted from the first time until the maximum pumping speed reaches 60 L/S being a half the speed in the first time. On the other hand, the pill-state NEG can be used for 3 times counted from the first time until the maximum pumping speed reaches 66 L/S being a half the speed in the first time. The NEG 1 of the first embodiment has a lifetime 3 times that of the pill-state NEG, which can be described to be significantly excellent in the viewpoint of lifetime.

Second Embodiment

An NEG of the second embodiment will be explained. The NEG of the second embodiment is different from the first embodiment only in shapes. Therefore, only the relevant portions will be explained, and duplicate explanation will be omitted while the same reference numerals as those of the first embodiment will be provided to the same members as those of the first embodiment.

Figure 7:
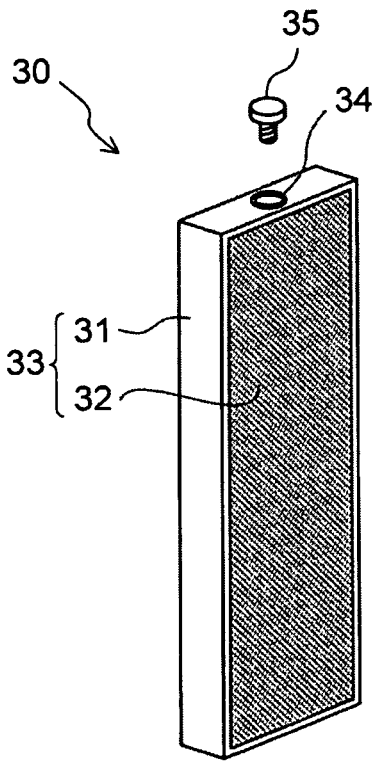
FIG. 7 is a perspective view illustrating a non-evaporable getter of a second embodiment.

FIG. 7 is a perspective view illustrating the NEG of the second embodiment.

In the NEG 30 of the second embodiment, as illustrated in FIG. 7, a thin and long stainless-steel plate is folded to fabricate a square and short cylindrical frame 31, the mesh 32 made of stainless-steel is stretched on both sides of the frame 31 so as to cover an opening of the frame 31 to form a container 33 for inputting the powder-state getter material 4. Similar to the first embodiment, a female screw 34 for inputting the getter material 4 is formed in the frame 31, and the female screw is plugged by a male screw 35.

A similar effect as that of the first embodiment can be also obtained by the NEG 30 of the second embodiment.

Herein, referring to the investigation result of the first embodiment, pumping speed of an NEG pump equipped with the NEG 30 of the second embodiment for hydrogen is estimated. The estimation is done as follows.

For example, the square cylindrical frame 31 has a thickness at 0.5 mm, a length in axis direction at 3 mm, a length of an inner long side at 100 mm, and a length of an inner short side at 12 mm. The mesh 32 is plain-woven, and an opening dimension is 41 μm. The powder-state getter material 4 is the same alloy as the first embodiment, and a particle size is 50 μm or more and 180 μm or less.

The total inner volume of the whole 40 containers 5 of the NEGs 1 of the first embodiment is approximately 2.1 times the inner volume of a single container 33 of the second embodiment. Assuming that an pumping speed be proportional to an inner volume of a container, the maximum pumping speed $S_{max}$ ($H_2$) of the NEG pump equipped with the NEG 30 of the second embodiment is approximately 57 L/S which is obtained by dividing 120 L/S by 2.1 per one NEG 30.

For example, since the inner diameter of the vacuum chamber to which the standard product CF152 of the Con-Flat flange is connected is about 100 mm, about 20 of the NEGs 30 (short side at 13 mm) can be arranged along an inner periphery (perimeter: approximately 314 mm) of the vacuum chamber. Herein, it is desirable that the NEG 30 is arranged to slightly separate from an inner wall of the vacuum chamber. The reason is to take in gas from the mesh 32 of the NEG 30 which faces the inner wall of the vacuum chamber. Then, by installing the radiation-type heater 16 as illustrated in FIG. 4 at the center, an NEG pump having high pumping speed of about 1140 L/S for hydrogen can be provided.

Modified Example of Second Embodiment

An NEG of a modified example of the second embodiment will be explained. In the NEG of the modified example of the second embodiment, a plurality of NEGs of the second embodiment are made connectable.

Figure 8:
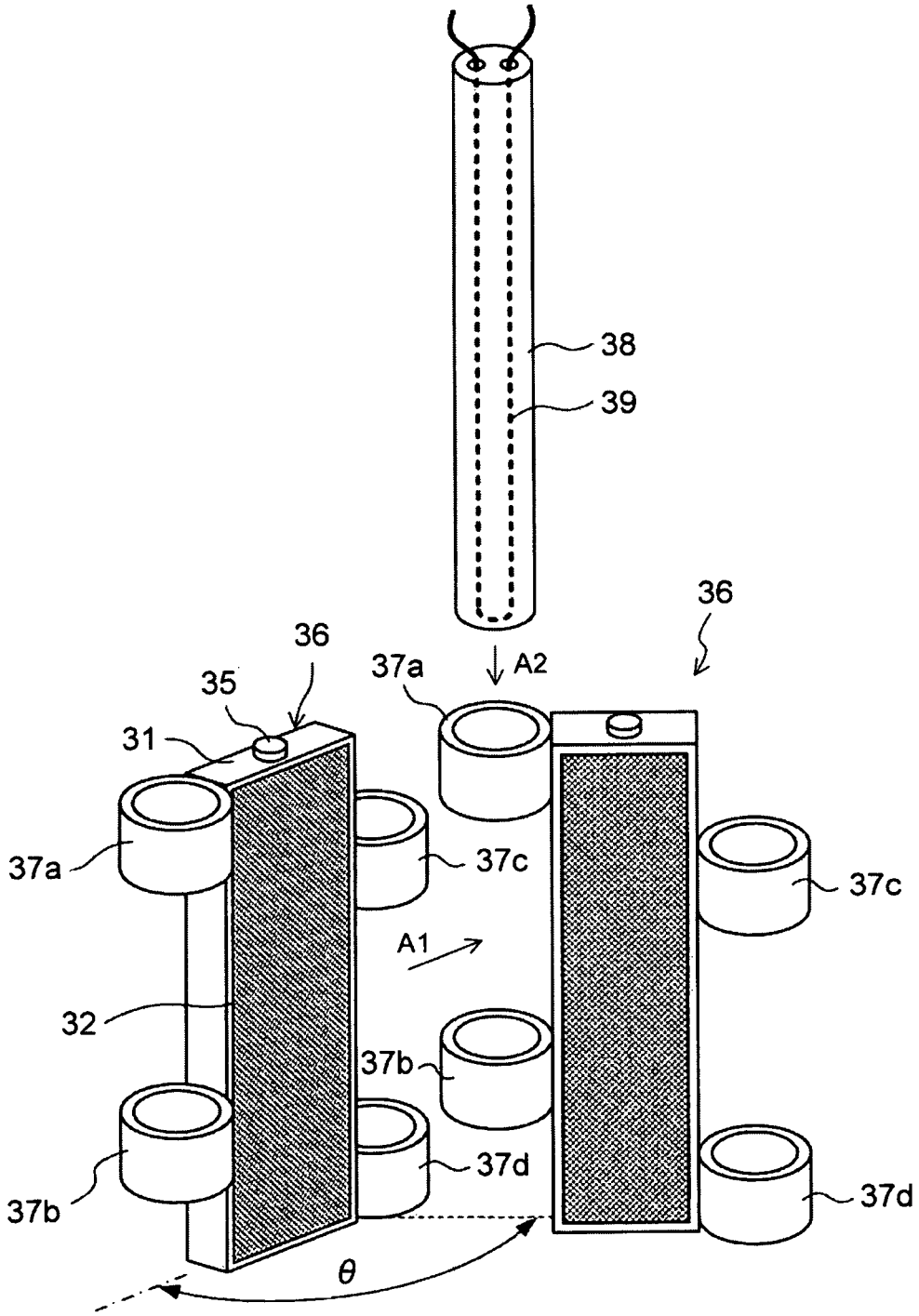
FIG. 8 is a perspective view illustrating a method of connecting a plurality of non-evaporable getters of a modified example of the second embodiment.

FIG. 8 is a perspective view illustrating a method of connecting the plurality of NEGs of the modified example of the second embodiment.

Figure 9:
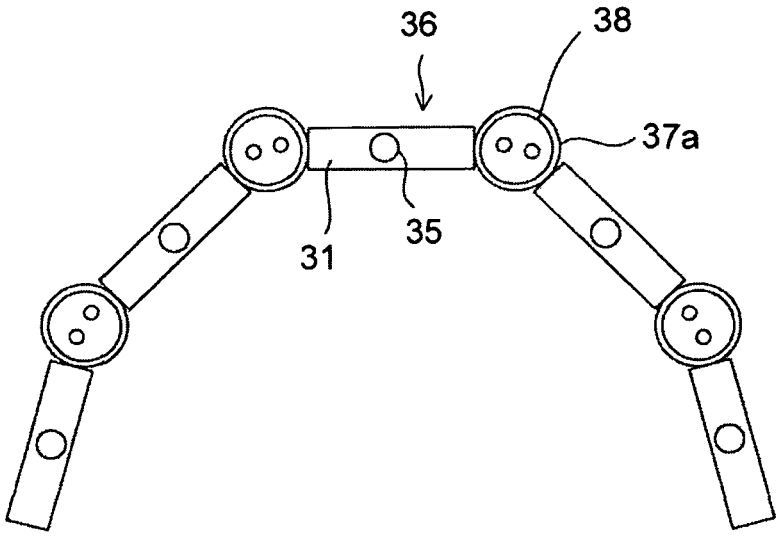
FIG. 9 is a plan view illustrating a state where the plurality of non-evaporable getters of the modified example of the second embodiment are connected.

FIG. 9 is a plan view illustrating a state where the plurality of NEGs of the modified example of the second embodiment are connected.

As illustrated in FIG. 8, in the plurality of NEGs 36 of the modified example of the second embodiment, each NEG 36 has two connecting members joined on each side of the frame 31, four cylinders 37*a*, 37*b*, 37*c*, 37*d* in total. Positions of the cylinder 37*a* and the cylinder 37*c* on upper side, and positions of the cylinder 37*b* and the cylinder 37*d* on lower side are shifted in a height direction, respectively.

The NEG 36 is moved in a direction indicated by an arrow A1 to match central axis of the cylinders 37*c*, 37*d* of the NEG 36 and central axis of the cylinders 37*a*, 37*b* of the adjacent NEG 36. Next, a ceramic rod 38 is inserted from above as illustrated by an arrow A2 into the cylinders 37*a*, 37*b*, 37*c*, 37*d* whose central axes are matched. This makes it possible to rotatably support and unify the adjacent NEGs 36 like a hinge.

The rod 38 includes two parallel long holes formed in the rod 38 along a central axis. A U-shaped tantalum heater 39 is inserted into the holes. With this, the rod 38 can serve as a heater to activate the getter material 4 of the NEG 36.

FIG. 9 illustrates an example in which 5 NEGs 36 are connected to each other, but the number of the NEGs 36 to be connected is not particularly limited.

According to the NEG 36 of the modified example of the second embodiment, a large number of the NEGs 36 can be connected to each other, so that there is no need to individually fix each the NEG 36 to the vacuum chamber. Further, since an angle θ between adjacent NEGs 36 can be freely adjusted, a large number of the connected NEGs 36 can be arranged in accordance with a shape of an inner wall of an accelerator, an electron microscope or the like, for example. Further, since the center surrounded by the connected NEGs 36 is unoccupied, it is also possible to let electron beam or X-ray beam to pass through the center.

Third Embodiment

An NEG of the third embodiment will be explained. The NEG of the third embodiment is different from the first embodiment only in shapes. Therefore, only the relevant portions will be explained, and duplicate explanation will be omitted while the same reference numerals as those of the first embodiment will be provided to the same members as those of the first embodiment.

Figure 10:
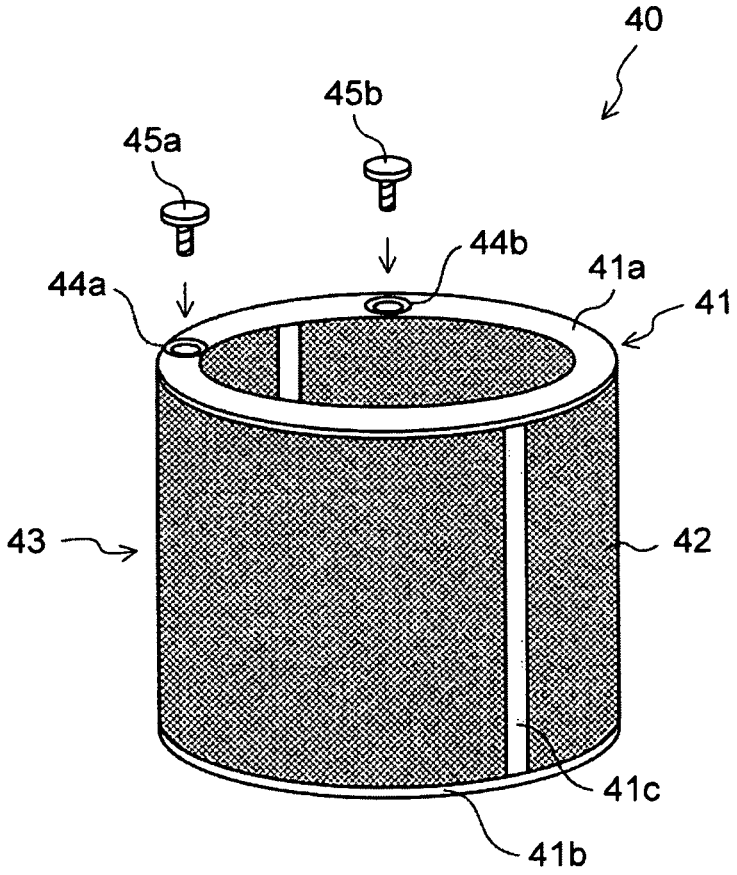
FIG. 10 is a perspective view illustrating a non-evaporable getter of the third embodiment.

FIG. 10 is a perspective view illustrating the NEG of the third embodiment.

In an NEG 40 of the third embodiment, as illustrated in FIG. 10, after preparing an upper ring 41*a* and a lower ring 41*b* which both are made of stainless-steel and rectangular prism shaped support posts 41*c* connecting the rings, a frame 41 is fabricated using them. Then, a mesh 42 is stretched inside and outside the frame 41 to fabricate a container 43 for inputting the powder-state getter material 4. Two support posts 41*c* are prepared, and are severally welded to the upper ring 41*a* and the lower ring 41*b*.

The container 43 is divided into two half-cylindrical spaces partitioned by the two support posts 41*c* which are opposed to each other to interpose center axes of the rings 41*a*, 41*b* between the two support posts 41*c*. After inputting the powder-state getter material 4 from the female screws 44*a*, 44*b* formed in the upper ring 41*a*, the female screws are plugged by the male screws 45*a*, 45*b*. The number of the support posts 41*c* can be increased to improve a suppressing effect of deformation of the mesh 42 as well.

A similar effect as the first embodiment can be obtained by the NEG 40 of the third embodiment. Particularly according to the cylindrical NEG 40 of the third embodiment, by installing the radiation-type heater 16 in the central unoccupied portion (inside the rings 41*a*, 41*b*) as illustrated in FIG. 4, an NEG pump using only the single NEG 40 can be provided.

Performance Investigation of NEG Pump of Third Embodiment

The NEG 40 of the third embodiment and an NEG pump equipped with the NEG were fabricated in the conditions below, and performance was investigated.

In the frame 41, an outer diameter of each of the upper and lower rings 41*a*, 41*b* was set to 36 mm, an inner diameter of it was set to 30 mm and a width of it was set to 3 mm. The support post 41*c* was a right square prism, in which a length of one side of a bottom surface was set to 3 mm and a height was set to 44 mm. The stainless-steel mesh 42 is plain-woven and its opening dimension is 41 μm. The powder-state getter material 4 same as the first embodiment is used. The powder-state getter material 4 of 41*g* (forty one gram) could be input in the container 43 of the NEG 40.

The heater 16 similar to that in the first embodiment was installed at the center of the NEG 40 to constitute an NEG pump. The pumping speeds S ($H_2$) for hydrogen and S (CO) for carbon monoxide were investigated in the same method as that of the first embodiment and given into a graph. Results as illustrated in FIG. 11 were obtained.

Figure 11:
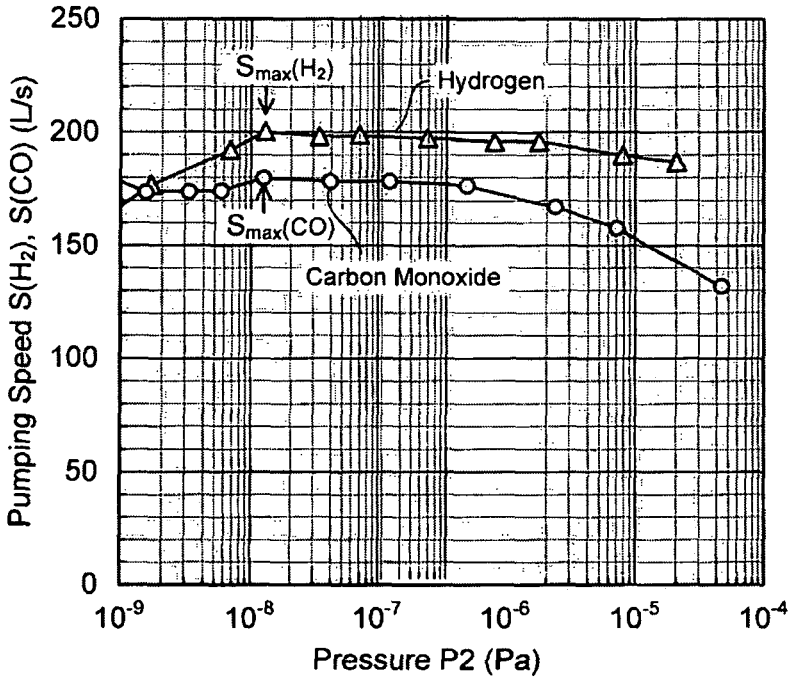
FIG. 11 is a graph illustrating investigation results of the performance of a non-evaporable getter pump equipped with the non-evaporable getter of the third embodiment by using the vacuum apparatus of FIG. 5.

FIG. 11 is a graph illustrating investigation results of the performance of an NEG pump equipped with the NEG of the third embodiment. The vacuum apparatus of FIG. 5 is used for the investigation. In FIG. 11, Δ marks denote the pumping speed S ($H_2$) for hydrogen, and ○ marks denote the pumping speed S (CO) for carbon monoxide.

The maximum pumping speed $S_{max}$ ($H_2$) for hydrogen was approximately 200 L/S, the maximum pumping speed $S_{max}$ (CO) for carbon monoxide was approximately 180 L/S. According to the NEG 40 of the third embodiment, significantly larger pumping speed than that of a conventional pill-state NEG could be obtained over the entire range of measured pressure for each of hydrogen and carbon monoxide.

Fourth Embodiment

An NEG of the fourth embodiment will be explained. The NEG of the fourth embodiment is different from the first embodiment only in shapes. Therefore, only the relevant portions will be explained, and duplicate explanation will be omitted while the same reference numerals as those of the first embodiment will be provided to the same members as those of the first embodiment.

Figure 12:
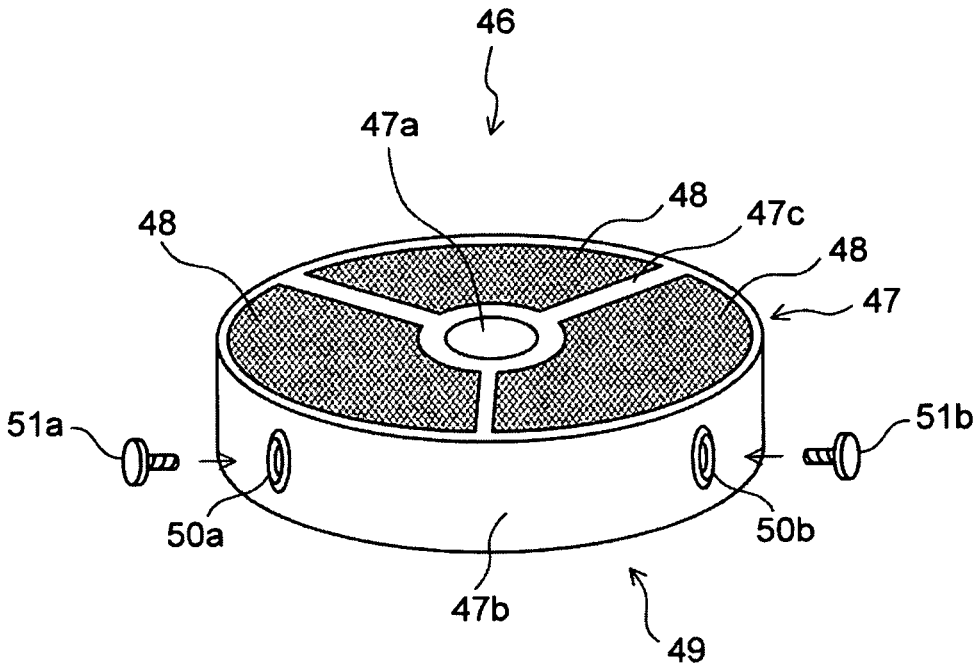
FIG. 12 is a perspective view illustrating a non-evaporable getter of a fourth embodiment.

FIG. 12 is a perspective view illustrating the NEG of the fourth embodiment.

In the NEG 46 of the fourth embodiment, as illustrated in FIG. 12, a stainless-steel frame 47 includes an inner short cylinder 47*a* and an outer short cylinder 47*b* whose central axes match each other, and three plates 47*c* connecting the cylinders, which forms a shape like a wheel. In order to fabricate such frame 47, a plate having a width 3 mm may be processed by laser cut, for example.

A container 49 for inputting the powder-state getter material 4 is fabricated by stretching a stainless-steel mesh 48 on both sides of the cylinders 47*a*, 47*b* so as to cover three sector-shaped openings between the two cylinders 47*a*, 47*b*. The container 49 is divided into three spaces partitioned by plates 47*c* which are put by an angle of approximately 120 degrees around the inner cylinder 47*a*.

The powder-state getter material 4 is input from female screws 50*a*, 50*b* formed in the outer cylinder 47*b* into the container 49. Afterwards, the female screws are plugged by male screws 51*a*, 51*b*. Note that there is another pair of the female screw and the male screw, but FIG. 12 does not illustrate them because they are on a rear surface.

A similar effect as the first embodiment can be obtained according to the NEG 46 of the fourth embodiment as well.

Next, an example of an NEG pump equipped with the NEG 46 of the fourth embodiment will be explained.

Figure 13:
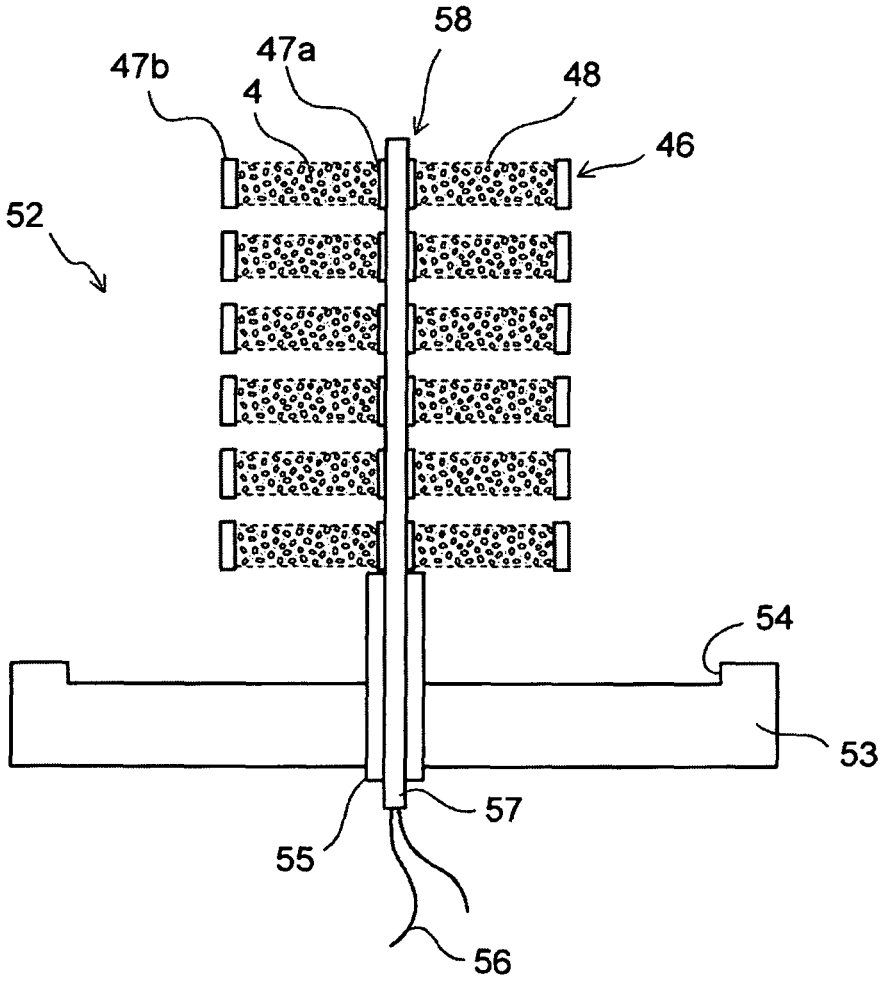
FIG. 13 is a cross-sectional view illustrating a non-evaporable getter pump equipped with a plurality of the non-evaporable getters of the fourth embodiment.

FIG. 13 is a cross-sectional view illustrating an NEG pump equipped with the plurality of NEGs of the fourth embodiment.

As illustrated in FIG. 13, the NEG pump 52 equipped with the NEG 46 of the fourth embodiment is connected to a vacuum chamber (not illustrated) via a disc-shaped vacuum flange 53. An edge 54 for sandwiching a gasket (not illustrated) is formed on the vacuum flange 53.

The vacuum flange is penetrated in a thick columnar central part 55, and a sheath heater 58 is inserted into the central part penetrated and is fixed. The sheath heater 58 is formed by surrounding a heating wire 56 with a metal tube 57.

An outer diameter of the tube 57 of the sheath heater 58 is matched with an inner diameter of the inner cylinder (frame) 47*a* of the NEG 46 in advance. With this, a large number of the NEGs 46 can be attached directly and easily to the sheath heater 58 merely by putting the inner cylinder 47*a* around the tube 57. FIG. 13 illustrates a state where 6 pieces of the NEGs 46 are attached to the sheath heater 58, for example. In the pump, the sheath heater 58 heats the NEGs 46 from inside to activate the getter material 4 of the NEGs 46. Since the sheath heater 58 is arranged at the center of each wheel-shaped NEG 46, it is possible to evenly and efficiently transmit heat from the sheath heater 58 to the getter material 4 of each the NEG 46.

The diameter and the thickness of the NEG 46, and the length of the sheath heater 58 can be freely designed. When the NEGs 46 having the thickness 3 mm are put around the sheath heater 58 having the length of 10 m at a gap of 10 mm, for example, 700 pieces or more of the NEGs 46 can be attached to the sheath heater 58. The NEG pump with high pumping speed which is constituted in this manner is preferable as an NEG pump used by being attached on a side face of a beam duct of an accelerator.

Next, a specific holding method of NEG will be explained referring to FIGS. 14A to 14C.

Figure 14A:
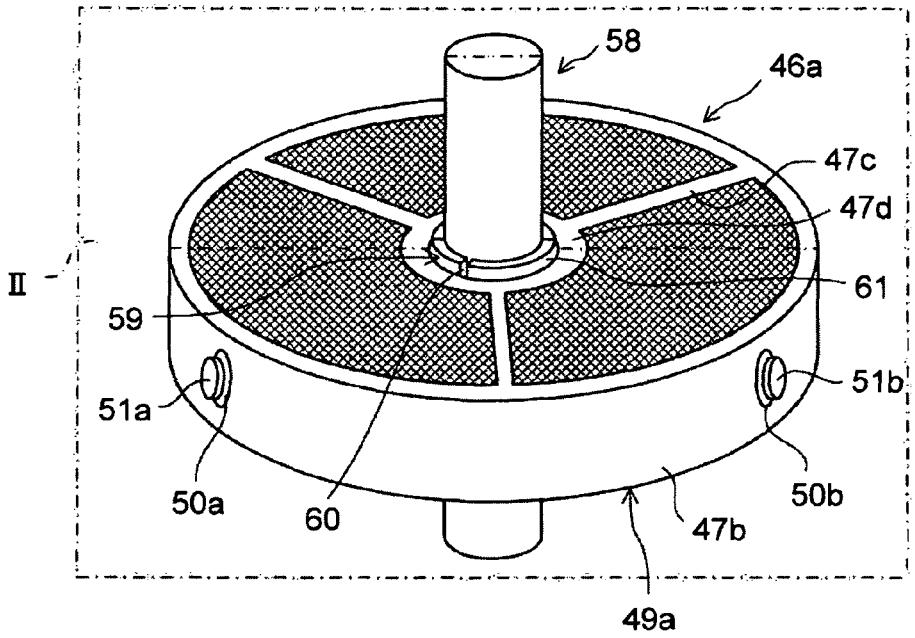
FIGS. 14A to 14C are views illustrating an example of a holding method of the non-evaporable getters in the non-evaporable getter pump of FIG. 13.
Figure 14B:
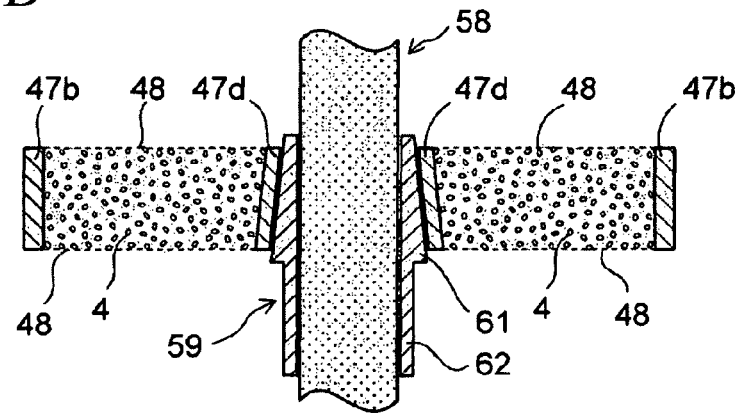
Figure 14C:
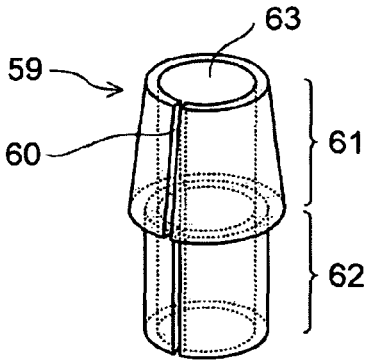

FIGS. 14A to 14C are views illustrating an example of holding methods of the non-evaporable getter in the non-evaporable getter pump of FIG. 13. FIG. 14A is a perspective view, FIG. 14B is a cross-sectional view along the plane II of FIG. 14A, and FIG. 14C is a perspective view of a C-cut tapered screw being a holding member of the non-evaporable getter.

An NEG 46*a* as illustrated in FIGS. 14A, 14B, in which the shape of the inner frame 47*a* of the container 49 illustrated in FIG. 12 is modified, is used. That is, a frame 47*d* has a hole through which the sheath heater 58 is inserted, and an inner wall of the hole has a trapezoidal cross section along an axis direction. In addition, the frame 47*d* serves as a taper-type female screw in which a thread is formed on the inner wall of the hole, although not illustrated, in a manner such that a C-cut tapered screw (fixing member) 59 can be threadably mounted on the inner wall of the hole and can be moved through the hole in an axis direction.

Note that, in FIGS. 14A, 14B, elements illustrated by the same reference numerals as those described in FIG. 12 and FIG. 13 indicate the same elements as those described in FIG. 12 and FIG. 13.

In the holding method as illustrated in FIGS. 14A,14B, the C-cut tapered screw 59 is sandwiched between the inner frame 47*d* of the container 49*a* and the rod-shaped sheath heater 58 inserted into the frame 47*d*. The C-cut tapered screw 59 is screwed into the frame 47*d* to fix the NEG 46*a* to the sheath heater 58.

In the C-cut tapered screw 59, as illustrated in FIGS. 14B, 14C, a through hole 63 having a constant diameter is formed at the central part along an axis direction, and has a shape similar to a cylinder. The sheath heater 58 can be inserted into the through hole 63.

The C-cut tapered screw 59 is constituted of an upper part 61 to be inserted into the frame 47*d* and a lower part 62 whose outer diameter is smaller than an outer diameter of at least a lower end of the upper part 61 and constant. A length of the upper part 61 is approximately 5 mm, and a length of the lower part 62 is approximately 7 mm. A cross section along an axis direction of the upper part 61 is trapezoidal corresponding to the shape of the hole of the frame 47*d*. And the upper part 61 serves as a taper-type male screw in which, although not illustrated, a thread is formed on an outer peripheral surface, in a manner such that the upper part 61 can be threadably mounted on the inner wall of the frame 47*d* and can be moved through the hole in the axis direction.

Further, a slit 60 is formed on a cylinder of the C-cut tapered screw 59 from an upper end to a lower end along the axis direction, and thus separates the cylinder. The width of the slit 60 is approximately 1 mm. Due to the slit 60, the diameter of the through hole 63 of the C-cut tapered screw 59 becomes smaller in proportion to fastening of the C-cut tapered screw 59.

The C-cut tapered screw 59 is inserted into the frame 47*d* from the lower end of the frame 47*d* in the state where the sheath heater 58 is inserted into the through hole 63 of the C-cut tapered screw 59.

Furthermore, by screwing the C-cut tapered screw 59 into the frame 47*d*, the diameter of the through hole 63 becomes smaller, and thereby the C-cut tapered screw 59 fastens the sheath heater 58.

Thus, the NEG 46*a* is fixed firmly to the sheath heater 58.

Figure 15:
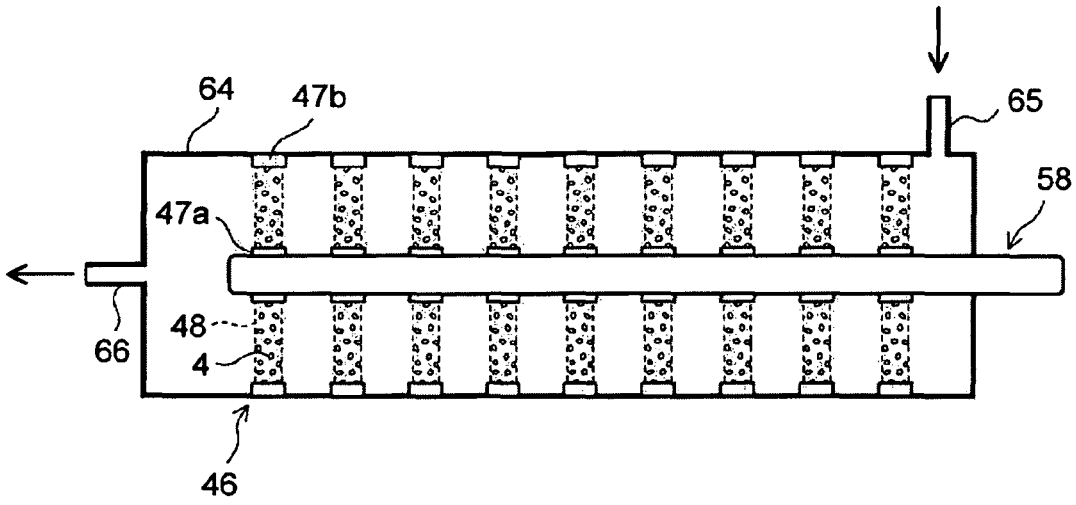
FIG. 15 is a cross-sectional view of a gas purifier using the non-evaporable getter pump of FIG. 13.

The NEG 46, other than the above application, is applied for fabrication of a gas purifier which is used in a semiconductor field as illustrated in FIG. 15. Note that the NEG 46 and the sheath heater 58 illustrated in FIG. 15 are the same as the NEG 46 and the sheath heater 58 illustrated in FIG. 12, respectively.

10 NEGs 46 whose diameters respectively match the inner diameter of the cylinder 64*a*, for example, are input into a metal cylinder 64*a* in a state that the 10 NEGs 46 are put around the sheath heater 58 at a gap of 2 to 3 mm. Then, both ends of the cylinder 64*a* are covered to form an airtight container 64. The heater is fixed to one end of the container 64 while central axes of the sheath heater 58 and the cylinder 64*a* are matched each other.

An openable and closable inlet 65 for introducing gas into the container 64 is provided for one end side of the cylinder 64*a*. Further, an openable and closable outlet 66 for taking out gas from inside the container 64 is provided for the other end of the container 64.

After pumping from an inside of the container 64 and activation of the NEG 46 are performed to bring the inside of the container 64 to a vacuum state, gas to be refined, such as helium gas and argon gas, is introduced from the inlet 65.

While the gas passes through a large number of the NEGs 46, impurity, such as oxygen, water, carbon monoxide, carbon dioxide, and hydrogen, is removed from the gas to a 1 ppb level. Then, high-purity refined gas can be taken out from the outlet 66.

Note that the sheath heater 58 is used in FIG. 15, but a heater provided for the outside of the container 64 may be used instead of the sheath heater 58 to activate the NEG 46.

Further, the NEG can be arranged in various forms corresponding to applications, other than the above-described embodiments.

Fifth Embodiment

In this embodiment, NEG powder fabricated by a reactive gas laser atomization process will be explained.

The reactive gas laser atomization process is a method in which alloy particles of powder are directly created. The method includes preparing a composite wire containing an alloy material or a rod-shaped body in which a metal wire is wound with another metal tape and combustion-synthesizing it by using a laser heat source, arc plasma melting or the like under argon atmosphere.

The reactive gas laser atomization process itself is a known art (non-patent document), and there is an example to fabricate TiFe alloy powder body (particle) with a particle size at 20 to 180 μm. However, an example applied to fabricating the NEG powder material is not known.

Its strongest reason is that the particle fabricated by the reactive gas laser atomization process is in a spherical shape and a relatively uniform size, which is not suitable as a powder material used in conventional NEG getter. This point will be explained below further in detail.

The conventional NEG is used by compressing NEG powder into a pill state or a ribbon shape for easiness of handling. There is totally no NEG product that uses the powder itself.

In the case of compressing powder into a pill state or a ribbon shape, it is difficult to compress the powder without binder when each particle of the powder is in a relatively uniform size and a spherical shape without a corner. In the case, it is preferable that each particle of the powder has much projection on a surface and uneven sizes. Therefore, the conventional NEG powder is fabricated by the following pulverization.

In fabricating the NEG powder by the pulverization, ternary alloy of zirconium 70%, vanadium 24.6% and iron 5.4%, for example, is used. At first, an alloy ingot is fabricated by using a high-frequency furnace in vacuum or in argon atmosphere. Next, the ingot is input into a metal pulverizer in argon atmosphere to pulverize into particles of several μm to several hundred μm. Consequently, the particles having shapes suitable for compressing into a pill state or a ribbon shape are obtained.

On the other hand, since the particles themselves are used in the present application, it is not preferable that each particle has much projection on a surface and uneven sizes. In the case, it is preferable that each particle has a uniform size and a spherical shape without a corner.

In other words, since each particle has a spherical shape without a corner, the particles are prevented from becoming even finer by contact or shock. Consequently, as described above, reduction of pumping speed can be suppressed even if exposure to the atmosphere for activation is repeated.

Further, pumping speed can be improved because the particles are uniform in an appropriate size.

For this reason, in the case of using the NEG powder material fabricated by pulverization in the present invention, the powder needs to be used after removing corners of the particles and sorting sizes as described above. Such work can be omitted by using the NEG powder material fabricated by the reactive gas laser atomization process. Further, from such point of view, the NEG formed of the powder-state getter material 4 may be referred to as the granulated NEG.

What is claimed is:

1. A non-evaporable getter comprising:

a frame including an inner cylinder and an outer cylinder that are disposed concentrically with each other, and a plurality of plates that connect the inner cylinder and the outer cylinder;

a first mesh that is stretched across to an upper end of the outer cylinder from an upper end of the inner cylinder;

a second mesh that is stretched across to a lower end of the outer cylinder from a lower end of the inner cylinder;

a housing portion that is surrounded by the first mesh, the second mesh and the frame; and a powder-state getter material that is housed in the housing portion and whose particle size is larger than a mesh opening of each of the first mesh and the second mesh.

2. The non-evaporable getter according to claim 1, further comprising a female screw that is formed on the outer cylinder of the frame and a male screw that is plugged into the female screw.

3. A non-evaporable getter pump comprising:

a non-evaporable getter including:

a frame having an inner cylinder and an outer cylinder that are disposed concentrically with each other, and a plurality of plates that connect the inner cylinder and the outer cylinder, a first mesh that is stretched across to an upper end of the outer cylinder from an upper end of the inner cylinder, a second mesh that is stretched to cross from a lower end of the inner cylinder to a lower end of the outer cylinder, a housing portion that is surrounded by the first mesh, the second mesh and the frame, and a powder-state getter material that is housed in the housing portion and whose particle size is larger than a mesh opening of each of the first mesh and the second mesh; and a heater that is inserted into the inner cylinder.

4. The non-evaporable getter pump according to claim 3, wherein the heater is a sheath heater that is formed by surrounding a heating wire with a metal tube.

5. The non-evaporable getter pump according to claim 4, further comprising a C-cut tapered screw that is sandwiched between the inner cylinder and the sheath heater.

* * * * *